United States Patent [19]

Heeren

[11] 4,120,162

[45] Oct. 17, 1978

[54] PLANT COMPRISING A POWER STATION AND A COOLING TOWER

[75] Inventor: Hermann Heeren, Nuremberg, Fed. Rep. of Germany

[73] Assignee: Maschinenfabrik Augsburg-Nurnberg Aktiengesellschaft, Nuremberg, Fed. Rep. of Germany

[21] Appl. No.: 740,727

[22] Filed: Nov. 10, 1976

[30] Foreign Application Priority Data

Nov. 11, 1975 [DE] Fed. Rep. of Germany ..... 2550527

[51] Int. Cl.[2] ..... F01K 9/00

[52] U.S. Cl. ..... 60/690; 165/DIG. 1; 165/129; 261/DIG. 11

[58] Field of Search ..... 165/DIG. 1, 111, 125, 165/12; 60/690, 692, 693; 261/DIG. 11

[56] References Cited

U.S. PATENT DOCUMENTS 2,907,554 10/1959 Heller ..... 165/125
3,150,267 9/1964 Caldwell ..... 60/670 X

FOREIGN PATENT DOCUMENTS 1,401,617 11/1968 Fed. Rep. of Germany ..... 60/690
1,936,137 2/1971 Fed. Rep. of Germany ..... 60/690
2,417,290 10/1975 Fed. Rep. of Germany ..... 60/690

*Primary Examiner*—Albert W. Davis, Jr.
*Attorney, Agent, or Firm*—Walter Becker

[57] ABSTRACT

A plant including a power station with power station buildings of a heavy construction and with a cooling tower surrounding the power station buildings, especially a steam power plant with natural draft-cooling tower for dry cooling. The cooling tower has a manner known per se designed as double mantle construction with an inner bowl and an outer bowl surrounding the inner bowl in spaced relationship thereto. The outer walls of the power plant buildings form a portion of the inner bowl or form the entire inner bowl. The remaining cooling tower portions and the outer bowl are designed as light structures. Any portion of the inner bowl which might possibly extend upwardly from the power plant buildings rest on the power plant buildings while the outer bowl on one hand rests on the ground by way of a support structure, and on the other hand by way of wind bracing members rests on the power plant buildings.

6 Claims, 2 Drawing Figures

PLANT COMPRISING A POWER STATION AND A COOLING TOWER

The present invention relates to a plant comprising a power station with power buildings carried out as a heavy structure and also comprising a cooling tower surrounding said power station. The present invention in particular refers to a steam power station with a natural draft cooling tower for dry cooling.

The German periodical "Elektrizitatswirtschaft" 1964, Issue 23, discloses a natural draft cooling tower according to which the power station (machine and boiler buildings, smoke stack and the like) is arranged within the inner chamber of the cooling tower. The cooling tower surrounds the power station in spaced relationship thereto. The power station buildings and cooling tower are separate buildings while each building has the corresponding strength.

German Offenlegungsschrift No. 22,60,404 discloses a cooling tower for mixed wet and dry cooling, according to which the dry cooling elements are arranged all the way around a second tower which latter annularly surrounds the wet cooling tower. The said two towers can be designed as light structures if they are supported by a conical surrounding structure.

It is an object of the present invention to further develop a plant of the above mentioned type so that the overall structure will require a minimum of structural elements.

It is another object of the invention to provide a plant as set forth in the preceding paragraph which will permit keeping space required by the plant to a minimum. These and other objects and advantages of the invention will appear more clearly from the following specification in connection with the accompanying drawing in which.

Figure 1:
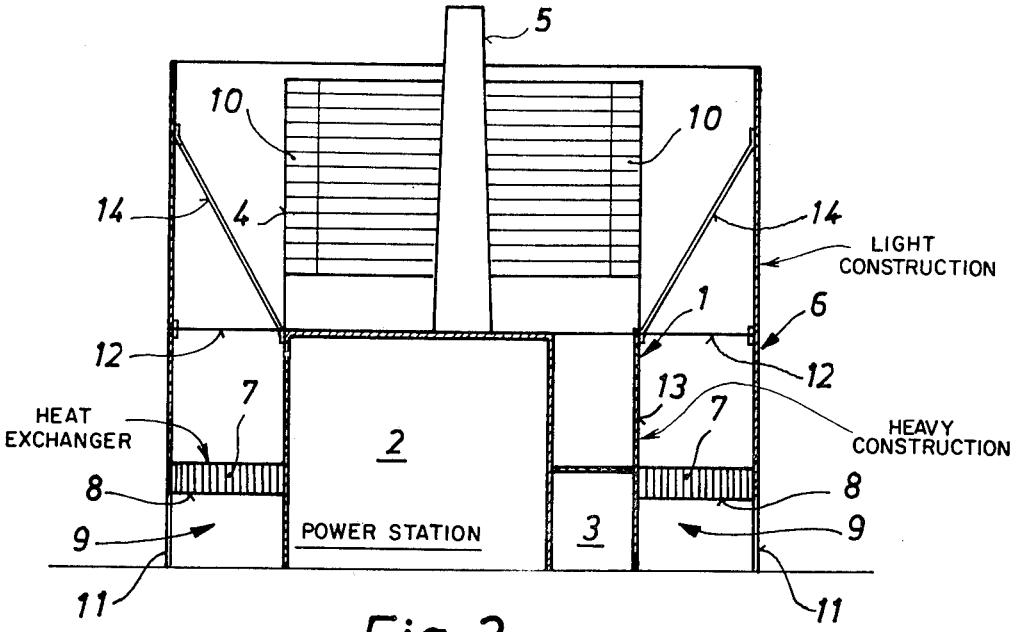
FIG. 1 illustrates a longitudinal section through a power plant with natural draft cooling tower for dry cooling.
Figure 2:
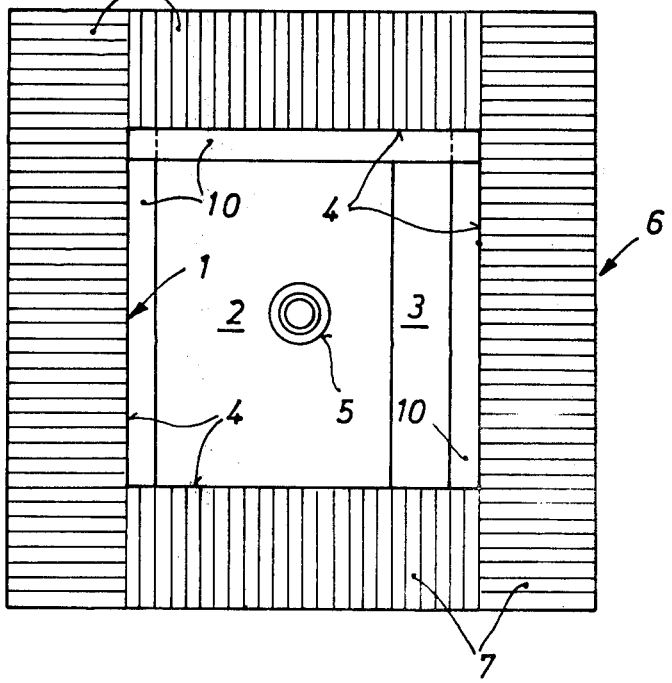
FIG. 2 is a top view of the plant shown in FIG. 1.

The power plant according to the present invention is characterized primarily in that with the cooling tower built up as a double mantle and provided with an inner bowl and an outer bowl surrounding said inner bowl in spaced relationship thereto, the outer walls of the power station building form a portion of the inner bowl or form the inner bowl. The plant according to the invention is furthermore characterized in that the remaining cooling bowl sections or the outer bowl is designed as a light construction while a possible section of the inner bowl which extends from the power station buildings in upward direction is supported by the power station buildings and while the outer bowl on one hand through the intervention of a supporting structure rests on the ground, and on the other hand rests on power station buildings through the intervention of cross bracing.

Referring now to the drawing in detail, the arrangement shown therein comprises an inner tower 1 which has a lower section including power station buildings namely the boiler house 2, an engine house 3, which power station buildings are of a relatively heavy structure and completely fill in a square shaped area. The walls of the power station building form the lower section of the inner bowl of the double mantle cooling tower and furthermore form the walls 13 of a relatively heavy structure and extend from the relatively low engine house 3 to the upper edge of the boiler house 2. The remaining portion of the inner bowl, which means the walls 4 which are supported by the power station buildings and extend from the upper edge of the boiler house 2 in upward direction are of relative light construction of a type known per se and may be designed for instance as a steel skeleton with cover. The smoke stack 5 of the power plant is located in the longitudinal central axis of the inner tower and is supported by the power station buildings 2, 3. Arranged around the inner tower 1 and preferably coaxially with said inner tower, but spaced therefrom is an outer tower 6. The bowl of the outer tower 6 is a relatively light construction of a type known per se and on one hand rests directly on the power station buildings 2 and 3 designed as a heavy construction and on the other hand rests in a manner known per se on the ground through the intervention of a supporting structure 11 having openings. The weight of the outer bowl is through the supporting structure 11 conveyed into the foundation. For receiving and conveying the stresses due to wind or the like, the outer bowl is through transverse and diagonal struts 14 or bracing connected in a framework-like manner to the boiler house 2 and that section (walls 13) of the inner bowl which is located above the engine house 3. The transverse struts or bracing 12 are located at the level of the upper edge of the boiler house. The lower end points of the diagonal struts 14 on the heavy structure are likewise located at the level of the upper edge of the boiler house.

In the space between the inner tower 1 and the outer tower 6 there are provided heat exchange elements 7 of the dry cooling system and are arranged in a horizontal or at an incline outwardly ascending arrangement. The lower edge 8 of the outer bowl is located above the ground for admitting cooling air 9. The distance between the lower edge of the outer cooling tower and the bottom or ground is so selected that the introduction of coal, the withdrawal of current, of ashes as well as the inward and outward movement of trucks and railway cars can be carried out through the opening of the supporting structure without any difficulties.

While the cross section of the outer tower may principally be selected at will, the cornered cross section is to be preferred because such cross section permits a more favorable arrangement of the horizontal or inclined outwardly ascending heat exchanger elements.

The height of the double mantle cooling tower depends on the required air through-put for the heat exchanging elements 7. The outer tower 6, however, is at least as high as the inner tower 1.

If desired, hot houses 10 may be arranged in the inner chamber of the inner tower 1 above the boiler and the engine houses.

The power plant buildings and the corresponding cooling tower sections are designed as customary skeleton structures (supporting structures) of finished steel concrete members or as a steel framework, cover, for instance "Eternit", aluminum sheet metal or the like. The invention is also applicable to double walled natural draft cooling towers for wet cooling and also to forced air double walled cooling towers. The heat exchange elements of the dry cooling system may also be arranged vertically in a manner known per se.

The section (wall 4) of the inner bowl which extends beyond the upper edge of the power plant buildings may be omitted. However, in such an instance there exists the danger that the warm air current of the cooling tower is influenced negatively.

The transverse struts or lateral wind bracing 12 may be of different type than that referred to above. Thus, with a circular cross section of the inner and outer bowls, the bowls may be connected to rings by means of radially inwardly directed wire cables or the like, said rings surrounding the smoke stack in slightly spaced arrangement thereto and rest against said smoke stack at different heights.

It is, of course, to be understood that the present invention is, by no means, limited to the specific showing in the drawing but also comprises any modifications within the scope of the appended claims.

What I claim is:

1. A plant, especially steam power plant, which includes: a power station with power station buildings having outer walls of a heavy weight conventional construction and with a cooling tower forming a double mantle construction surrounding said power station buildings and comprising in combination an inner cooling tower section and an outer cooling tower section surrounding said inner cooling tower section in spaced relationship thereto, the outer walls of said power station buildings forming at least a portion of said inner cooling tower section, and at least a portion of said outer cooling tower sections being of a light weight construction, any portion of said inner cooling tower section extending upwardly from said power plant buildings rests on said power plant buildings, supporting means associated with said outer cooling section for resting the latter on the ground, and wind bracing means likewise associated with said outer cooling section and resting said outer cooling section on said power plant buildings.

2. A plant in combination according to claim 1, in which said outer cooling tower section coaxially surrounds said inner cooling tower section.

3. A plant in combination according to claim 2, which includes horizontally extending cooling means arranged between said inner and outer cooling tower sections.

4. A plant in combination according to claim 3, in which said cooling means are dry cooling means.

5. A plant in combination according to claim 2, which includes inclined outwardly ascending cooling means arranged between said inner and outer cooling tower sections.

6. A plant in combination according to claim 1, in which said inner cooling tower section has a square shaped cross section.

* * * * *